US011179760B2

(12) United States Patent
Möck et al.

(10) Patent No.: US 11,179,760 B2
(45) Date of Patent: Nov. 23, 2021

(54) METHOD OF PRODUCING A BENT PART AND BENDING MACHINE FOR PERFORMING THE METHOD

(71) Applicant: WAFIOS Aktiengesellschaft, Reutlingen (DE)

(72) Inventors: Jörg Möck, Sonnenbühl (DE); Frank Weiblen, Metzingen (DE); Harry Schweikardt, Sonnenbühl (DE); Ralf Schneider, Nehren (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 117 days.

(21) Appl. No.: 16/626,806

(22) PCT Filed: Jun. 14, 2018

(86) PCT No.: PCT/EP2018/065864
§ 371 (c)(1),
(2) Date: Dec. 26, 2019

(87) PCT Pub. No.: WO2019/001982
PCT Pub. Date: Jan. 3, 2019

(65) Prior Publication Data

US 2020/0130038 A1 Apr. 30, 2020

(30) Foreign Application Priority Data

Jun. 26, 2017 (DE) ..... 10 2017 210 714.6

(51) Int. Cl.
*B21D 7/02* (2006.01)
*B21F 1/00* (2006.01)

(52) U.S. Cl.
CPC ..... *B21D 7/02* (2013.01); *B21F 1/006* (2013.01)

(58) Field of Classification Search
CPC ..... B21D 7/00; B21D 7/02; B21D 7/04
See application file for complete search history.

(56) References Cited

U.S. PATENT DOCUMENTS

| | | | |
|---|---|---|---|
| 2005/0172690 | A1 | 8/2005 | Cappello et al. |
| 2005/0210945 | A1 | 9/2005 | Maier et al. |
| 2010/0307231 | A1 | 12/2010 | Allard et al. |

FOREIGN PATENT DOCUMENTS

| | | | |
|---|---|---|---|
| CH | 534 551 | A | 3/1973 |
| CN | 105436355 | A | 3/2016 |
| DE | 27 23 846 | A1 | 12/1977 |
| DE | 35 46 449 | A1 | 9/1986 |

(Continued)

OTHER PUBLICATIONS

The First Office Action dated Feb. 24, 2021, of counterpart Chinese Application No. 201880055540.6, along with an English translation.

*Primary Examiner* — Teresa M Ekiert
(74) *Attorney, Agent, or Firm* — DLA Piper LLP (US)

(57) ABSTRACT

A method produces a bent part from an elongate workpiece, in particular from a wire or a tube from round, flat, or profiled material, by a bending machine, the workpiece is fed to a bending unit of the bending machine, wherein the bending unit has a bending head which by a Z-drive is displaceable in a manner parallel with a bending head axis and has a bending tool which by a bending drive is rotatable about a bending axis. A fed portion of the workpiece by operating movements of the bending head is formed to a two-dimensionally or three-dimensionally bent part.

6 Claims, 5 Drawing Sheets

(56) References Cited

FOREIGN PATENT DOCUMENTS

| | | | |
|---|---|---|---|
| EP | 0 123 231 | A1 | 10/1984 |
| EP | 1 535 675 | A1 | 6/2005 |
| EP | 2258494 | A1 | 12/2010 |
| EP | 2 999 556 | B1 | 4/2017 |
| FR | 2 749 199 | A1 | 12/1997 |
| FR | 2833868 | A1 | 6/2003 |

Fig. 5a
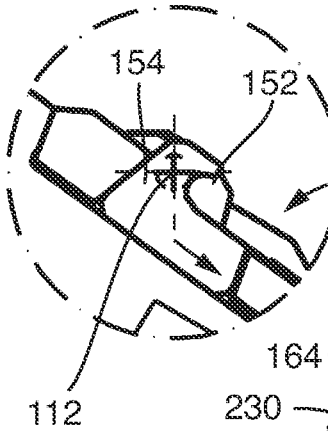
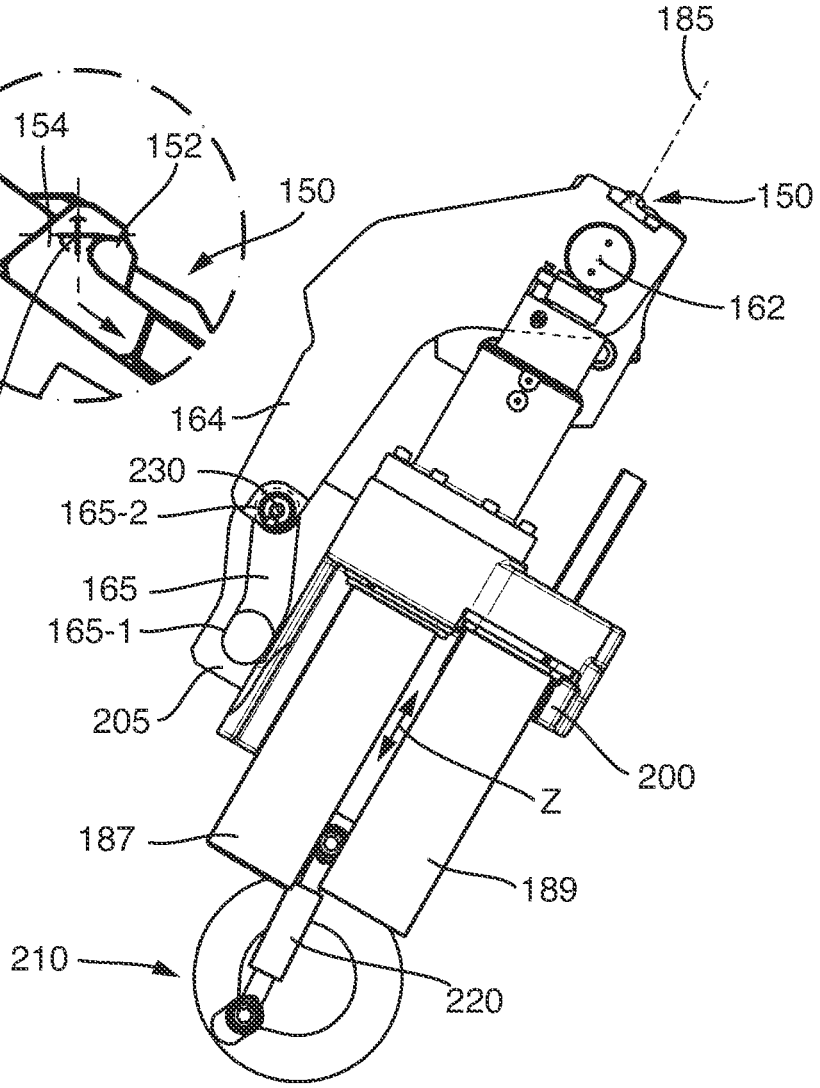
Fig. 5b

METHOD OF PRODUCING A BENT PART AND BENDING MACHINE FOR PERFORMING THE METHOD

TECHNICAL FIELD

This disclosure relates to a method of producing a bent part, as well as to a bending machine that carries out the method. A preferred field of application is in bending wires or tubes.

BACKGROUND

In the automated production of two-dimensionally or three-dimensionally bent parts with the aid of numerically controlled bending machines, the movements of machine axes of a bending machine are actuated in a coordinated manner with the aid of a control installation to, by plastic forming, generate one or a plurality of permanent bends on the workpiece, for example, a wire, a tube, a line, or a bar, from round, flat or profiled material.

The workpiece in an automated bending process is formed with the aid of a bending machine that has a bending head having a rotatable bending tool for engaging on a portion of the workpiece to be bent and the orientation of which on account of the bending operation by plastic deformation is to be permanently changed in relation to a portion which is not to be bent. A tool which is stationary during the bending operation and often referred to as a bending mandrel can also be provided on the bending head.

The rotatable bending tool with the aid of a bending drive controlled by a control installation is rotatable about a bending axis. The bending axis is the rotation axis of the rotatable bending tool of the bending head. The bending plane runs to be perpendicular to the bending axis. The bending operation generates on the workpiece a planar bend in a manner parallel with the bending plane. The rotatable bending tool can have, for example, a bending pin which for bending is brought into a position to bear on one side of the portion to be bent, in a manner spaced apart from the bending axis. Bending pins are used, for example, when bending wire.

In the bending process, a workpiece portion to be provided with a bend is first moved to an initial position in the engagement region of the bending head. To this end, a workpiece portion of a suitable length of a longer workpiece supply by an infeeding operation in a manner parallel with an infeeding direction can be moved or fed, respectively, to the initial position. This approach is commonplace when bending wires and can also be provided when bending comparatively thin tubes.

The rotatable bending tool is thereafter brought into contact with the portion to be bent. Depending on the construction of the machine, this can take place, for example, by bringing to bear a bending pin on one side of the portion to be bent. The external contour of a bending mandrel herein can stabilize the internal contour of the bend and precisely predefine the radius of the bend. A bending operation without a bending mold is also possible.

A bend between the portion of the workpiece portion that is not to be bent and the portion that is to be bent is thereafter generated in a bending operation by rotating the rotatable bending tool about the bending axis. The non-bent portion and the bent portion after the bending procedure define a plane in which the generated bend also lies (planar bend).

If a further bend on the workpiece is to be generated in the same bending plane or in another bending plane, the bending head by way of a retraction movement in a manner parallel to a bending head axis is typically first moved from the bending position of the bending head (operating position in which a bending operation can be carried out) to a relocating position without an engagement with the workpiece. The workpiece thereafter, for example, for changing the bending plane, can be rotated about the infeed axis before the bending head by way of a feeding movement in a manner parallel with the bending head axis is moved from the relocating position back to the bending position with an engagement with the workpiece. A temporary retraction of the bending head to the relocating position is typically also provided when the bending direction is to be reversed (changing from bending to the left to bending to the right, or vice versa), to be able to rotate the bending pin to the opposite side of the workpiece before the bending head is moved forward again to the operating position (bending position) to commence the next bending procedure.

The machine axis which effects the feeding movements, or retraction movements, respectively, in a manner parallel with the bending head axis is referred to as the Z-axis. The associated drive controlled by way of the control installation is referred to as the Z-drive. The bending head axis, and thus the movement direction of the movements of the bending head caused by the Z-drive, typically run to be perpendicular to the direction in which the fed workpiece which has not yet been bent is oriented, thus to be perpendicular to the infeeding direction.

Once all bends that are envisaged for the bent part have been generated on the workpiece, the finished bent part in a cutting operation by a cutting installation is severed from the fed workpiece material. The cutting installations of the conventional bending machines considered herein are installations that are separate from the bending head and have the tools (cutting tool) provided for engaging on the workpiece and are required for severing the workpiece. A cutting installation typically has two cutting tools that are movable relative to one another for a cutting operation to be carried out. At least one of the cutting tools is assembled on a movable component of the cutting installation. The other cutting tool interacting with the movable component can be assembled to be fixed on the machine or be disposed to be likewise movable. For example, the cutting installation can have a first blade that is assembled to be fixed on the machine, and a second blade that is movable relative to the first blade, wherein the blades in the cutting operation shear off, or sever, respectively the bent part from the fed material in a type of shearing movement. Since none of the cutting tools is attached to the bending head, this results in degrees of freedom in terms of the constructive concept and arrangement of the cutting installation. For the cutting operation to be carried out, such conventional bending machines have a separate machine axis and an associated drive activated by the control installation when the cutting operation is to be carried out. The drive can operate electrically or else pneumatically or else hydraulically. At least one movable component of the cutting installation is moved by way of the drive.

It could therefore be helpful to provide a method of producing a bent part from an elongate workpiece material, in particular from a wire or a tube from round, flat, or profiled workpiece material, that in terms of construction can be implemented in a cost-effective and functionally reliable manner. It could further be helpful to provide a bending machine suitable for carrying out the method.

SUMMARY

Our method can be carried out automatically by a bending machine. The elongate workpiece, or a portion thereof, respectively, herein is fed to a bending unit of the bending machine. The workpiece herein by a drawing-in installation is preferably drawn off from a material supply and fed to the bending unit of the bending machine. The bending unit has a bending head which can carry out a plurality of different operating movements. The bending head, driven by a Z-drive, can be linearly displaced in a manner parallel with a bending head axis. The bending head has a bending tool which with the aid of a bending drive is rotatable about the bending axis. The bending axis typically coincides with the bending head axis so that the bending tool is rotated about the bending head axis (centric bending). The bending axis can also be a bending axis that is capable of being positioned or is positioned to be offset in a manner parallel with the bending head axis such that eccentric bending is also possible.

When the workpiece portion to be bent is moved to the position thereof, the fed portion of the workpiece by operating movements of the bending head is formed to a two-dimensionally or three-dimensionally bent part. Each single bending operation which is caused by rotating the bending tool herein generates a planar bend. By rotating the workpiece portion to be bent to another rotary position prior to the bending operation, a bend in another plane can be generated such that a three-dimensionally bent part can be produced. Once all bends envisaged for the bent part have been generated, the finished bent part with the aid of a cutting installation is severed from the fed workpiece material in a cutting operation.

The cutting installation is an installation separate from the bending head and has the tools (cutting tool) that are envisaged for engaging on the workpiece and are required for severing the workpiece. A cutting installation can have, for example, two cutting tools that are movable relative to one another to carry out a cutting operation. At least one of the cutting tools is assembled on a movable component of the cutting installation. The other cutting tool interacting with the movable component can be assembled to be fixed on the machine or be disposed to be likewise movable. Since in the cutting installation that is separate from the bending head none of the cutting tools are attached to the bending head, this results in degrees of freedom in terms of the constructive concept and arrangement of the cutting installation in relation to the bending head. The cutting forces that can be achieved by the cutting installation can be controlled on account of the design example of the transmission installation.

A particularity of the method claimed lies in that an operating movement of the bending head in a manner parallel with the bending head axis causes the cutting operation by a transmission installation, or activates the cutting installation by a transmission installation, respectively. The Z-drive of the bending head herein is used as the drive of a movable component of the cutting installation for carrying out the cutting operation.

Alternatively, it can be provided that a rotating movement of the bending tool about the bending axis activates the cutting installation by a transmission installation. The bending drive herein is used as the drive of a movable component of the cutting installation for carrying out the cutting operation.

More generally the cutting installation is activated by an operating movement of the bending head or one of the components of the latter, the operating movement going beyond the usual operating movement. This activation is not caused directly, but indirectly or in an intermediary manner, respectively, with the aid of a transmission installation.

In terms of construction, this concept of a bending machine can be implemented such that a movable component of the cutting installation that is separate from the bending head for transmitting forces and moments by a transmission installation is coupled to a drive of the bending head such that the cutting installation by way of the drive is activatable by the transmission installation, or in a manner relayed by the transmission installation, respectively.

The coupled drive is preferably the Z-drive which is responsible for the displacement movement of the bending head in a manner parallel with the bending head axis. The utilized Z-drive on account thereof is imparted a dual function.

Alternatively, the bending drive could be coupled to the cutting installation by way of a transmission installation. The cutting installation for transmitting forces and moments can thus in principle also be coupled to the bending drive (that is to say the drive of the rotatable bending tool) for the cutting operation to be carried out.

More generally in a generic method, or a generic bending machine, respectively, an operating movement of the bending head or of one of the components thereof activates the cutting installation by a transmission installation. The operating movement herein can in particular be an operating movement of the entire bending head (in a manner parallel with the bending head axis) or a rotating movement of the rotatable bending tool about the bending axis.

By providing a transmission installation that preferably operates in a fully mechanical manner, a dedicated drive for the cutting installation can be dispensed with such that the cutting installation does not require any drive that can be actuated separately by the control installation. By dispensing with such a separate dedicated drive for the cutting installation, a bending machine of this type can be produced in a substantially more cost-effective manner than conventional bending machines having a separate drive for the cutting installation. Moreover, installation space can be saved on account of which an overall more compact arrangement can be implemented.

Examples in which the cutting installation is activated exclusively by an operating movement of the bending head in a manner parallel with the bending head axis such that only the Z-drive has a dual function are particularly simple and robust.

According to one example, the movable component of the cutting installation that is movable by the drive of the bending head has a lever which is rotatable about a lever axis. This lever can also be referred to as a cutting lever. The lever can serve as a support of a movable blade of the cutting installation. The lever can be conceived as a dual-arm lever having lever arms of unequal lengths. The lever ratios are preferably chosen such that a relatively large operating stroke of the drive coupled thereto (for example, the drive of the bending head) effects a movement of the blade of the cutting installation that is supported by the movable component that is smaller in comparison to the operating stroke. On account of such a gearing by way of the lever, the coupled machine axis of the bending head, in particular the Z-axis, is less heavily stressed by the cutting forces arising in the cutting operation than in a likewise possible direct coupling without gearing. On the other hand, high cutting forces can be generated.

Alternatively, the transmission installation can have, for example, mutually meshing gear wheels or other machine elements suitable for constructing a mechanical transmission installation.

The transmission installation is preferably conceived such that a linear movement of the bending head in a manner parallel with the bending head axis across a first stroke portion between a bending position and a relocating position does not cause any movement of the movable component of the cutting installation that is coupled to the Z-drive. It can be achieved on account thereof that the cutting installation during the usual bending operation is practically decoupled from the Z-drive. Those operating movements of the bending head which when bending the workpiece as well as when relocating the bending head, or the bending tool, respectively, usually take place between successive bends, in particular thus a short-stroke retraction movement of the bending head from the operating position (bending position) to the relocating position in which the bending tool is no longer in engagement with the workpiece to be bent and a rotation of the bending tool is possible without contacting the workpiece, are referred to here as the "normal bending operation".

Multi-staged tools in which, for example, bending mandrels and/or bending pins have a plurality of levels having dissimilar radii and by the Z-axis can be moved to or into the operating plane, respectively, are also possible. These changes in the bending level should also be able to be carried out to be neutral in terms of the cutting movement.

According to one example, the transmission installation has a control curve that converts a uniform movement of the bending head in a manner parallel with the bending head axis to a non-uniform movement of the movable component of the cutting installation coupled to the Z-drive. In particular, the control curve can have a first curve portion which is oriented such that a linear movement of the bending head in a manner parallel with the bending head axis across a first stroke portion between the bending position and the relocating position does not cause any movement of the movable component of the cutting installation that is coupled to the Z-drive, and a second curve portion is contiguous to the first curve portion, the second curve portion being oriented obliquely to the first curve portion such that a further linear movement of the bending head in a manner parallel with the bending head axis beyond the relocating position causes a movement of the movable component of the cutting installation that is coupled to the Z-drive. It can be achieved on account thereof that the cutting installation is not actuated and accordingly no cut is performed in those operating movements of the bending head that take place only between the bending position and the relocating position, while a cutting movement for the cutting operation is generated in a further stroke that goes beyond the relocating position.

In examples in which the movable component of the cutting installation has a lever (cutting lever) that is rotatable about a lever axis, the advantageous kinematics can be implemented in that an angular groove forming the control curve is configured on a slide of the bending head that is movable in a manner parallel with the bending head axis, and in that a cam roller that engages in the groove is attached to a lever arm of the lever. It can be achieved on account thereof that a practically clearance-free transmission of forces and moments to the movable component of the cutting installation is present in a retraction movement of the bending head from the bending position via the relocating position, and moreover also in an operating movement in the direction counter thereto.

A reversed arrangement (having the groove on the lever and a cam roller on a slide of the bending head) is also possible.

BRIEF DESCRIPTION OF THE DRAWINGS

Further advantages and aspects are derived from the description hereunder of preferred examples explained hereunder by the figures.

FIGS. 3*a*, 3*b*, 4*a*, 4*b*, 5*a* and 5*b* show various operating positions of the bending head and of the cutting installation coupled thereto.

DETAILED DESCRIPTION

Figure 1:
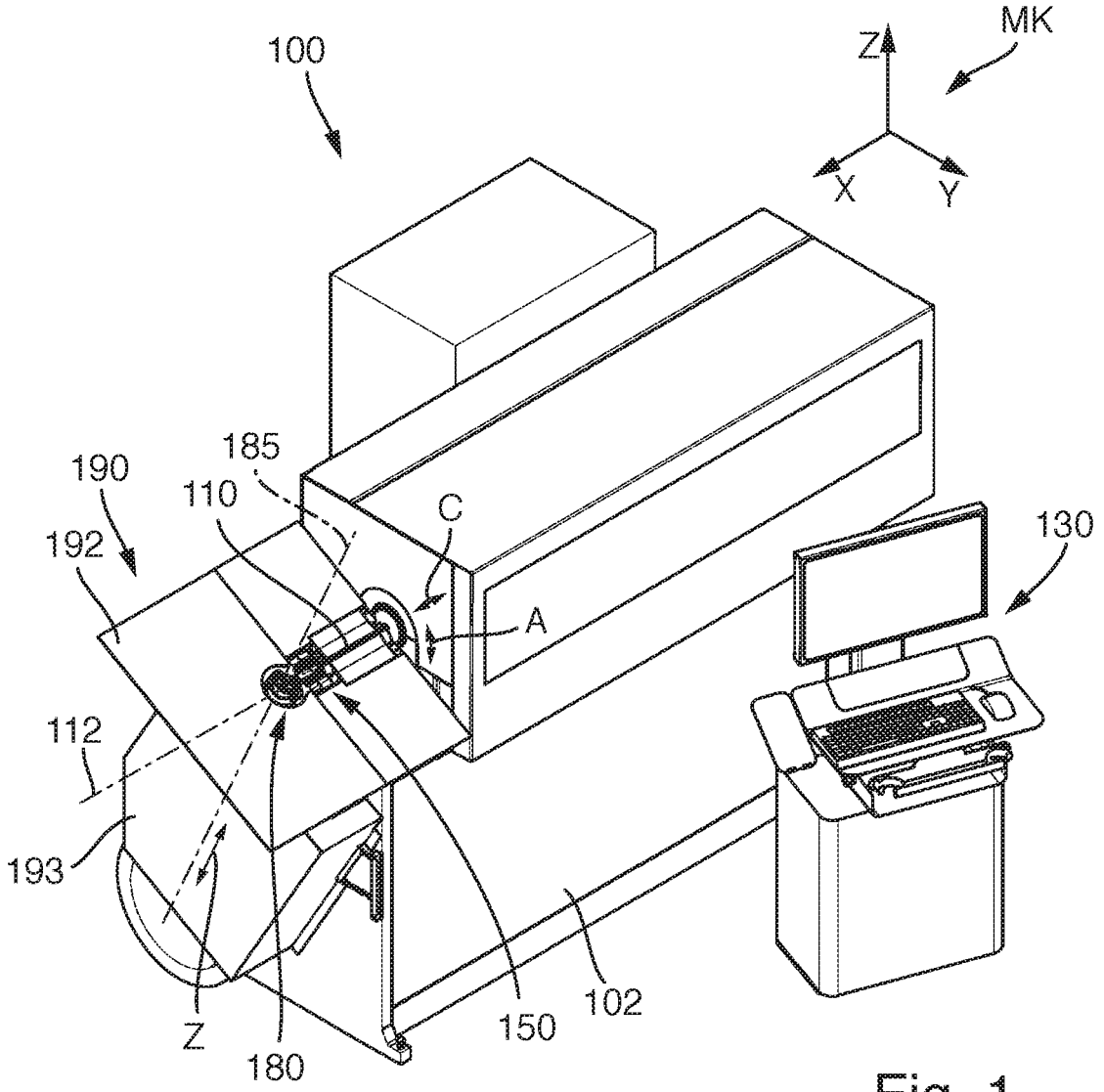
FIG. 1 shows an oblique perspective view of a bending machine according to one example, seen from the front side equipped with a bending head.
Figure 2:
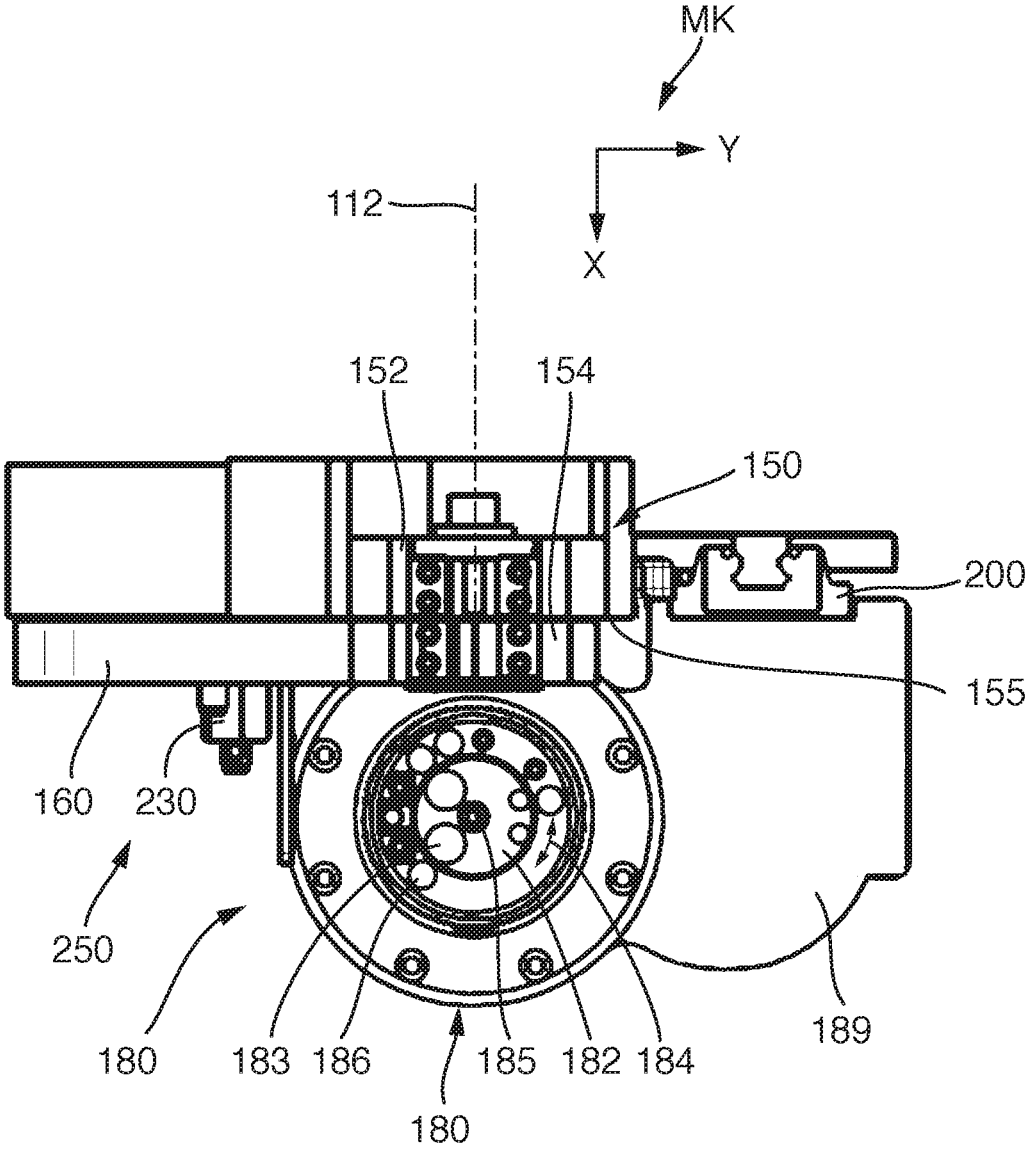
FIG. 2 shows a plan view of a fragment of the bending machine from FIG. 1, seen in the direction parallel to the bending head axis of the bending head.

Examples will be explained hereunder by a computer numerically controlled bending machine 100 specified for bending wire. FIG. 1 shows an oblique perspective front view of the single-head bending machine. FIG. 2 shows a plan view of a fragment of the bending machine from FIG. 1, seen in the direction parallel with the bending head axis of the bending head of the bending machine.

The bending machine 100 as a wire bending machine provides a portion of an elongate workpiece 110 in the form of a wire having a preferably round cross section with one or a plurality of bends in one or a plurality of bending planes by cold forming. Wires having a flat or profiled cross section can also be bent.

The bending machine 100 in the example has an orthogonal machine coordinate system MK having a vertical z-axis and a horizontal x-axis and y-axis, the machine coordinate system MK being identified by the lowercase letters x, y, and z. In the illustrated example, the x-axis runs in a manner parallel with the workpiece axis 112 of the not yet bent workpiece. The machine axes which are driven in a controlled manner and each of which is identified by uppercase letters (for example, A, C, Z, etc.) are to be differentiated from the coordinate axes.

All of the drives for the machine axes are electrically connected to a control installation (not illustrated) which contains inter alia the power supply to the drives, a central computing unit, and data storage units. The movements of all of the machine axes are variably controlled with the aid of the control software active in the control installation to generate a coordinated movement of the elements participating in the bending procedure. A display and operating unit 130 connected to the control installation serves as an interface to the machine operator.

For a bend to be generated, an initially straight workpiece portion is moved to an initial position in the engagement region of the bending head 180. To this end, the operation proceeds from a comparatively long workpiece supply (coil) in accordance with the illustrated example.

To this end, the bending machine has a drawing-in installation (not visible in FIG. 1) equipped with drawing-in rollers and which by way of a numerically controlled feeding rate profile in the horizontal direction (in a manner parallel with the x-direction) can draw in or feed, respectively, successive wire portions of a wire emanating from a wire supply and possibly guided through an optional straightening unit into the region of the bending head 180. The wire at the exit side is guided through a tubular wire guide and exits in the horizontal infeeding direction. The feeding (the drawing-in movement) is stopped once the wire reaches an initial position. The linear machine axis for the infeeding is referred to as the C-axis and has a motor (not illustrated).

The wire when feeding exits from the front end of the wire guide, thereafter runs through the region of a cutting installation 150 (yet to be explained later) into the engagement region of the bending head 180. The cutting installation 150 is disposed between the drawing-in installation and the bending head.

A rotation of the workpiece about the workpiece longitudinal axis, for example, for changing the bending plane, is generated by way of the rotary drive of the A-axis. On account thereof, the drawing-in installation in its entirety can be rotated conjointly with the straightening unit about an axis which is parallel with the x-axis.

The bending head 180 has an internal tool part 182 which is stationary during the bending procedure and in the plan view (cf. FIG. 2) has a cylindrical external contour. The tool part on the upper side thereof supports a plurality of exchangeable bending mandrels of dissimilar diameters, of which in each instance one (for example, the bending mandrel 183) can be moved to an operating position close to the workpiece axis to serve as an internal support of the workpiece portion in the bending procedure. The external diameter of the bending mandrel 183 utilized establishes the bending radius of the bend to be generated, thus the curvature radius of the bend. A separate drive output 187 (servomotor and gearbox) is provided for rotating the internal tool part 182 about the bending head axis 185 for changing over between different bending mandrels. The corresponding machine axis is also referred to as the mandrel axis.

Furthermore, the bending head 180 has a bending tool 184 which is rotatable in relation to the internal tool part and is provided for engaging laterally on a portion of the workpiece material to be bent. The bending tool 184 on the upper side thereof supports a bending pin 186 and by a bending drive 189 (servomotor and gearbox) controlled by the control installation is rotatable about a bending axis which here coincides with the bending head axis 185. The orientation of the bending axis establishes the orientation of the bending plane which lies to be orthogonal to the bending axis and includes the workpiece axis 112.

The bending unit having the bending head 180 in many examples is pivotable as an entity about an axis that runs in a manner parallel to the x-axis such that the bending axis 185 can be aligned selectively to be vertical (parallel with the z-direction) or to be oblique thereto in an inclined position. In the example illustrated, the bending unit as an entity is disposed at a fixed angle in relation to the vertical z-axis. It is possible for the angle be 0°, thus z=Z. An inclination of 20° to 30° in relation to the vertical is usual. As has been mentioned, a manual or motorized pivoting installation is also possible. It is important herein that the bending unit is pivoted as an entity, thus including the bending axis and the Z-axis. To this end, the tool elements of the bending head are assembled in a solid support 193 which in pivotable variants can be guided in arcuate guides on the front wall of the machine base 102. A metallic table top 192 of a bearing table 190 is assembled on the upper side of the support, the planar upper side of the bearing table 190 in each position of the bending head lies slightly below the level of the workpiece axis 112. The bearing table serves as a bearing for those portions of a bending part that protrude beyond the bending head, and as a chute by way of which the finished bent parts after having been severed from the material supply can slide laterally into a collection container.

Further details relating to the construction and the function of the bending machine 100 can be understood particularly readily by FIGS. 2 to 5*b*. FIG. 2 herein shows a plan view of a fragment of the bending machine from FIG. 1, seen in the direction parallel with the bending head axis 185 of the bending head 180. The cutting installation 150 which is disposed between the drawing-in installation for the workpiece (not illustrated in FIG. 2) and the bending head 180 can also be seen herein. FIGS. 3*a* to 5*b* show views of the bending machine in the region of the bending head 180 and of the cutting installation 150, seen in a direction parallel with the x-axis of the machine coordinate system, or parallel with the infeeding direction of the workpiece to be bent, respectively.

The cutting installation 150 is an installation separate from the bending head 180 and which has the tools (cutting tools) required for severing the workpiece. The cutting tools are those components of the cutting installation that are provided for direct contact with the workpiece, or for engaging on the workpiece, respectively. No tools of the cutting installation are attached to the bending head. Degrees of freedom in terms of the constructive concept and arrangement of the cutting installation 150 in relation to the bending head 180 result in the use of a cutting installation that is separate from the bending head.

Figures 3A, 3B:
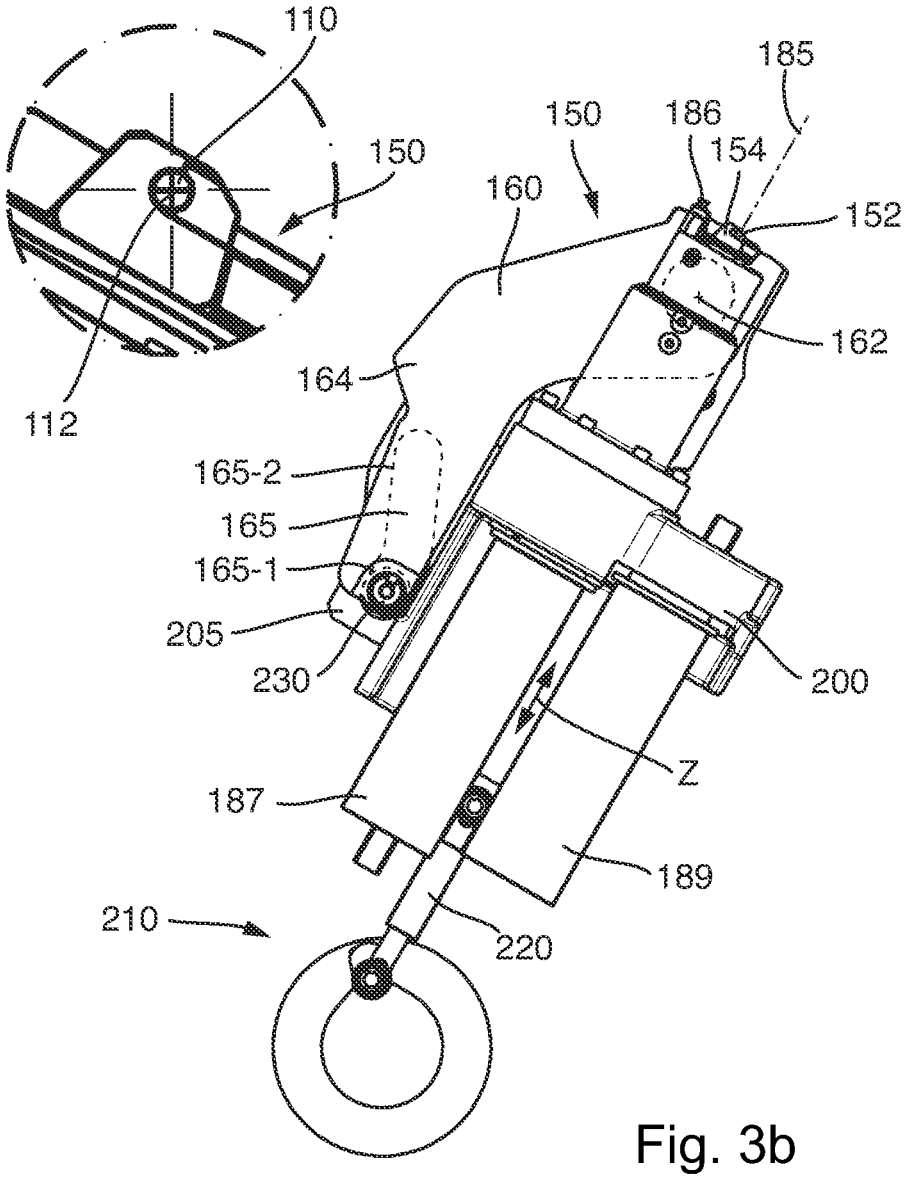

FIG. 3*b* shows the components of the bending machine in a first position which is also referred to as the bending position. The bending head 180 in this first position is situated in the terminal position thereof that is closest to the workpiece and in which the bending pin 186 of the bending tool is introduced into the workpiece plane such that a rotation of the bending tool can cause a bend on the workpiece. As can be seen in the enlarged detail in FIG. 3*a*, the cutting installation 150 herein is situated in an opened position without any cutting engagement on the workpiece. Feeding of workpiece material in the infeeding direction (parallel with the x-axis, or with the workpiece longitudinal axis 112, respectively) is possible in the opened position.

Figures 4A, 4B:
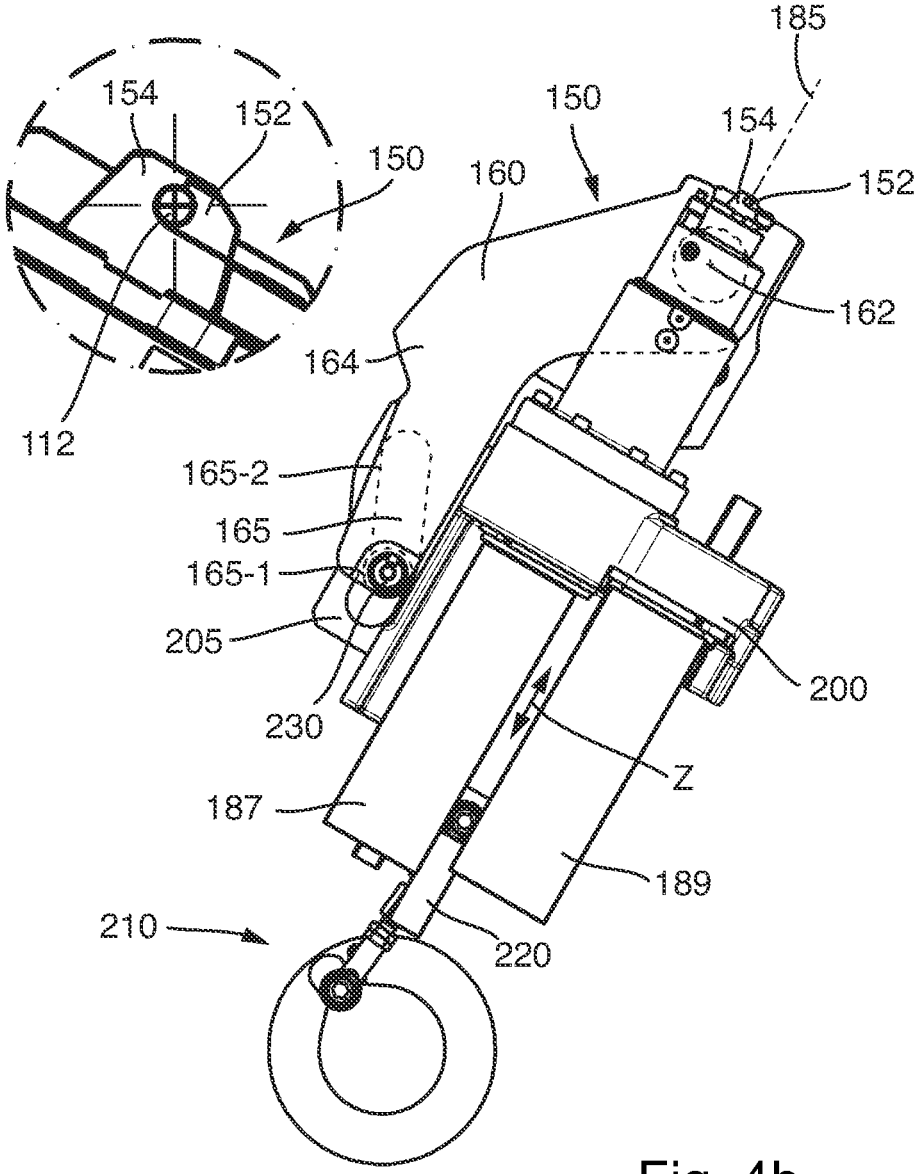

FIG. 4*b* shows the same components in a second position which here is also referred to as the relocating position. The bending head 180 herein is situated in a position which is slightly retracted (for example, by approx. 10 mm to approx. 20 mm, possibly even more or less, depending on the wire diameter) in relation to the bending position and enables a relocation of the bending pin, thus a rotation of the bending tool without any engagement on the workpiece. As can be seen in FIG. 4*a*, the cutting installation continues to be in an opened position.

FIGS. 5*a* and 5*b* finally show a configuration or position, respectively, in which the bending head 180 is situated in the lowered position thereof which is retracted farthest from the workpiece. The cutting installation 150 is activated in the movement from the relocating position to the lowermost position such that the finished bent part is severed from the fed workpiece portion. Structural components which enable this advantageous functionality are explained in more detail hereunder.

The bending head 180, or the components thereof, respectively, are assembled on a linearly displaceable slide 200 also referred to as the bending slide. The displacement direction of the slide runs to be perpendicular to the infeeding direction of the wire, thus to be perpendicular to the x-direction of the machine coordinate system. The orientation of the bending slide establishes the orientation of the bending head axis 185 in relation to the infeeding direction of the workpiece. The bending head as an entirety can be linearly displaced in a manner parallel with the bending head axis 185. That numerically controlled machine axis that causes the linear movement of the bending head in a manner parallel with the bending head axis is referred to here as the Z-axis. The associated drive which here is referred to as the Z-drive comprises a crank mechanism 210 which is rotatable about a rotation axis that runs in a manner parallel with the x-axis. The slide 200 is coupled to the crank mechanism 210 of the Z-drive by way of a transmission rod 220.

A plate-shaped portion 205 in which an angular groove, or a groove curve 165, is incorporated is attached to the slide 200 on the side of the lever 160, the slide 200 enabling the linear movement of the bending head. The groove, also referred to as the control groove, can be subdivided into a first portion 165-1 which is aligned to be parallel with the bending head axis 185, and a second portion 165-2 which is set to be oblique in relation to the first portion, or the bending head axis, respectively. The first portion and the second portion are each substantially rectilinear and in relation to one another enclose an acute angle of approx. 20° to 40°. The second portion 165-2 in terms of length is more than double the first portion 165-1.

The cutting installation 150 is constructed such that a finished bent part in a cutting operation can be severed from the fed workpiece portion in the manner of a shear cut. A first blade 152 of the cutting installation 150 is assembled to be fixed on the machine with the aid of an adjustable blade support, that is to say to be fixedly assembled in relation to the machine base of the bending machine. The first blade 152 interacts with a second blade 154 assembled to be adjustable on a movable component 160 of the cutting installation. The exchangeable blades 152, 154 are the cutting tools of the cutting installation 150. The cutting gap 155 which defines the separation plane is situated between the blades. This shear cut is carried out when the second blade 154 in relation to the first blade 152 in the y-direction moves (on an arc) to be substantially parallel with the x-y plane.

The movable component 160 which supports the second blade 154 is a lever 160 (also referred to as the cutting lever 160) which is mounted to be pivotable about a rotation axis 162 which is fixed on the machine and runs to be parallel with the x-direction. The support structure for the second blade 154 is situated on the upper side of the lever 160 to be close to the rotation axis 162. A longer angular lever arm 164 protrudes downward to be substantially parallel with or at an acute angle to the bending head axis 185. A cam roller 230 is mounted to be rotatable on that end portion of the lever 160 facing away from the rotation axis 162. The cam roller 230 is guided in the angular groove 165 (groove curve, control groove) on the bending slide.

The cam roller 230 attached to the lever 160, and the angular groove 165 on the bending slide 200, are substantial component parts of a fully mechanical transmission installation 250 which for transmitting forces and moments couples a movable component of the cutting installation 150, specifically the lever 160 having the second blade 154 fastened thereon, to the Z-drive of the bending head 180 such that the cutting installation 150 can be activated exclusively by way of the Z-drive. The cutting installation 150 as well as the bending head 180 are thus activated by one and the same drive (the Z-drive) such that a separate drive is not required for the cutting installation.

The construction and the function of the example can also be described as follows.

The base part of the cutting installation 150, specifically a so-called cutting support, links the cutting installation 150 to the machine body of the bending machine and supports the rotation axis 162 for the lever (cutting lever) 160 as well as the first blade 152 which is assembled to be fixed on the machine. The lever (cutting lever) 160 is mounted to be rotatable on the cutting support. The articulation of the lever 160 takes place by way of the cam roller 230 fastened to the free lever end. The cam roller 230 runs in an angular groove curve 165. The groove curve 165 is fastened to the slide 200 (bending slide) and conjointly with the slide 160 moves up and down in a manner parallel to the bending head axis 185. This is the operating movement of the Z-axis of the drive system of the bending machine.

The groove curve 165 has a straight first portion 165-1 which runs to be parallel to the Z-axis movement, and a second portion 165-2 which runs at an angle in relation to the Z-axis movement. The two respective straight sections, or portions, respectively, of the groove curve are connected by a curved part that runs according to a principle of movement.

The Z-axis moves the bending head 180 up and down in a manner parallel with the bending head axis 185. The Z-axis in the example is driven by a crank, as is illustrated in the drawings, or by way of a ball screw spindle. Alternatively, the Z-axis can also be driven by way of any other solution suitable for linear drives.

In the first position (bending position) shown in FIG. 3*b* the bending head 180 is situated in a bending position in terms of the Z-axis. The lever 160 (cutting lever) is in the position opened for the passage of a wire (see detail 3*a*).

In the configuration of FIGS. 4*a* and 4*b* the bending head 180 in terms of the Z-axis is situated in a position for relocating the bending pin 186. This axial position is referred to as the relocating position. The bending finger in the relocating position can be guided below the wire, and the bending direction can thus be changed. It can be seen that the cam roller 230, when changing from the bending position to the relocating position, within the first portion 165-1 of the groove curve 165 has moved only in a manner linearly parallel with the bending head axis. No pivoting movement has thus been caused on the lever 160 such that the blades of the cutting installation continue to be situated in the opened position. In other words, the relative position of the blades of the cutting installation has not changed when transitioning from the bending position to the relocating position. In the normal bending operation, which possibly includes a multiple axial movement of the bending head from the bending position to the relocating position, the cutting installation is thus practically decoupled from the Z-drive.

Once the bending procedure has been completed after all envisaged bending operations for producing the bent part have been carried out on the workpiece, the cutting operation can be initiated. To this end, the bending head by the Z-drive is moved back beyond the relocating position to the maximum retracted position (cutting position). FIGS. 5*a* and 5*b* show a situation in which the bending head in terms of the Z-axis is situated in the third position for cutting the workpiece. The cam roller 230 on the displacement path from the relocating position to the retracted position by way of the transition portion between the first portion 165-1 and the second portion 165-2 moves into the second portion 165-2 and then along the second portion. The lever 160, by virtue of the oblique profile of the second portion 165-2, is pivoted ever more outward during the retraction movement such that the second blade 154 in a cutting movement is displaced relative to the first blade 152 and the wire is sheared off. The cutting procedure has been completely performed when the cutting lever is situated in the maximum deflected position shown in FIGS. 5*a* and 5*b*.

For a further bent part to be generated, the bending head by the Z-axis has to be mandatorily displaced upward again, at least to the relocating position so that the movable blade again releases the opening of the stationary blade.

The bending head 180 in this construction for relocating the bending tool in terms of the Z-axis thereof can be moved up and down without the lever 160 (cutting lever) moving. The bent part can be bent while the bending head moves in this region. When the bending procedure has ended and the bent part is to be severed by activating the cutting installation 150, the bending head moves beyond the relocating position further downward until the workpiece (the wire) has been cut off. The bent part can then drop out of the bending machine. The dropping of the bending part is facilitated on account of the comparatively low position of the bending head 180, thus on account of the very retracted position of the bending head, because the probability of the bending part catching on the bending head is significantly reduced on account thereof.

A complete machine axis, or a complete machine drive for the cutting installation, can thus be saved. At the same time, the movement of the Z-axis for relocating the tool continues to be possible without the cutting lever moving by way of the coupling action.

The invention claimed is:

1. A bending machine for producing a bent part from an elongate workpiece comprising:

a bending unit having a bending head which, by a Z-drive, is displaceable in a manner parallel with a bending head axis and has a bending tool which, by a bending drive, is rotatable about the bending axis; and a cutting installation for severing a finished bending part from the workpiece in a cutting operation, said cutting installation being separate from the bending head, wherein a movable component of the cutting installation for transmitting forces and movements is coupled exclusively to the Z-drive by a transmission installation such that the cutting installation is activatable exclusively by way of the Z-drive, and the transmission installation is configured such that a linear movement of the bending head across a first stroke portion between a bending position and a relocating position does not cause any movement of the movable component of the cutting installation that is coupled to the Z-drive.

2. A bending machine for producing a bent part from an elongate workpiece comprising:

a bending unit having a bending head which, by a Z-drive, is displaceable in a manner parallel with a bending head axis and has a bending tool which, by a bending drive, is rotatable about the bending axis; and a cutting installation for severing a finished bending part from the workpiece in a cutting operation, said cutting installation being separate from the bending head, wherein a movable component of the cutting installation for transmitting forces and movements is coupled exclusively to the Z-drive by a transmission installation such that the cutting installation is activatable exclusively by way of the Z-drive, and the transmission installation has a control curve which converts a uniform movement of the bending head along the bending head axis to a non-uniform movement of the movable component of the cutting installation that is coupled to the Z-drive.

3. The bending machine as claimed in claim 2, wherein the control curve has a first curve portion which is oriented such that a linear movement of the bending head in a manner parallel with the bending head axis across a first stroke portion between a bending position and a relocating position does not cause any movement of the movable component of the cutting installation that is coupled to the Z-drive, and a second curve portion is contiguous to the first curve portion, said second curve portion being oriented obliquely to the first curve portion such that a further linear movement of the bending head in a manner parallel with the bending head axis beyond the relocating position causes a movement of the movable component of the cutting installation that is coupled to the Z-drive.

4. The bending machine as claimed in claim 2, wherein the movable component of the cutting installation is a lever which is rotatable about a lever axis.

5. The bending machine as claimed in claim 2, further comprising a drawing-in installation for drawing off workpiece material from a material supply and feeding the workpiece material to the bending unit, wherein the cutting installation is disposed between the drawing-in installation and the bending head.

6. A method of producing a bent part from an elongate workpiece using a bending machine, the method comprising:

feeding workpiece material to a bending unit of the bending machine, wherein the bending unit has a bending head which, by a Z-drive, is displaceable in a manner parallel with a bending head axis and has a bending tool which, by a bending drive, is rotatable about a bending axis;

forming a fed portion of the workpiece material by operating movements of the bending head into a two-dimensionally or three-dimensionally bent part; and severing the bent part from the workpiece material in a cutting operation to obtain a finished bent part by a cutting installation that is separate from the bending head, wherein the cutting installation is activated exclusively by an operating movement of the bending head in a direction parallel to the bending head axis by a transmission installation, and the transmission installation has a control curve which converts a uniform movement of the bending head along the bending head axis to a non-uniform movement of the movable component of the cutting installation that is coupled to the Z-drive.

* * * * *